US006025704A

United States Patent [19]

Elliott

[11] Patent Number: 6,025,704

[45] Date of Patent: Feb. 15, 2000

[54] POWER SUPPLY WITH PROGRAMMABLE VOLTAGE SLEW RATE AND METHOD

[75] Inventor: Stephen H. Elliott, Bradenton, Fla.

[73] Assignee: Trilectron Industries, Inc., Miami, Fla.

[21] Appl. No.: 09/065,130

[22] Filed: Apr. 23, 1998

[51] Int. Cl.[7] ..... G05F 1/56

[52] U.S. Cl. ..... 323/280; 323/281; 323/901; 323/908; 363/49

[58] Field of Search ..... 323/274, 276, 323/277, 280, 281, 901, 908; 363/49; 361/56, 79

[56] References Cited

U.S. PATENT DOCUMENTS

| | | | |
|---|---|---|---|
| 4,219,872 | 8/1980 | Engelmann | 363/126 |
| 4,355,341 | 10/1982 | Kaplan | 361/79 |
| 4,490,779 | 12/1984 | Minks | 363/48 |
| 4,598,351 | 7/1986 | Fair et al. | 363/49 |
| 4,621,313 | 11/1986 | Kiteley | 363/49 |
| 4,679,130 | 7/1987 | Moscovici | 363/17 |
| 4,779,060 | 10/1988 | Henden | 330/277 |
| 4,878,164 | 10/1989 | Colombo | 363/49 |
| 4,893,228 | 1/1990 | Orrick et al. | 363/89 |
| 5,157,269 | 10/1992 | Jordan et al. | 307/59 |
| 5,414,340 | 5/1995 | Gannon | 323/266 |
| 5,453,678 | 9/1995 | Bertolini et al. | 323/282 |
| 5,550,461 | 8/1996 | Pouzoullic | 323/269 |
| 5,592,072 | 1/1997 | Brown | 323/268 |
| 5,619,126 | 4/1997 | Lang | 323/273 |
| 5,668,467 | 9/1997 | Pease | 323/315 |

*Primary Examiner*—Y. J. Han
*Attorney, Agent, or Firm*—Darby & Darby

[57] ABSTRACT

A power supply with a programmable voltage slew rate is disclosed for generating a regulated voltage at a predetermined set-point. The power supply includes a programmable current source for generating a controllable level of current flow and a capacitive element coupled to the current source. The capacitive element is responsive to the current flow to establish a reference voltage that varies linearly with respect to variations in the current flow. The power supply additionally includes a power device having a control element disposed in sensed communication with the reference voltage and an output for driving a load. The output is operative to generate an output voltage following that of the reference voltage.

25 Claims, 4 Drawing Sheets

POWER SUPPLY WITH PROGRAMMABLE VOLTAGE SLEW RATE AND METHOD

FIELD OF THE INVENTION

The invention relates to electronic DC power supplies and more particularly to a DC power supply having a controlled slew rate limiting circuit to protect electronic loads from line voltage transients and a linearly adjustable set-point capability.

BACKGROUND OF THE INVENTION

Regulated D.C. power supplies provide predictable and reliable voltage sources for driving electronic circuitry. The conventional power supply design typically employs a power device for developing a D.C. voltage output and a regulating feedback loop. The regulation loop serves to maintain the power supply output voltage at a pre-selected set point by sensing the output voltage and increasing or decreasing the output relative to the desired set point.

To dampen the response of the feedback loop by changing the supply output voltage from 0 volts to a preselected set point voltage relatively slowly, rather than instantaneously, many power supply designs employ a slew rate limiting circuit. The slew rate circuit tends to reduce the stress on any loads developed by the sudden application of power to a deenergized electronic circuit.

The dampening effect of the slew rate circuit also reduces any transient voltage overshoot associated with the power supply regulation loop. Overshoots often develop from the fast feedback response of the system that produces a high initial error at start-up, causing saturation of the control loop with a corresponding overshoot above the desired set point.

Conventional slew rate limiting circuits typically fall into two categories: rampable set points and modulation limiters. Rampable set point circuits are constructed to change the desired output voltage from 0 volts to the desired value smoothly over time. U.S. Pat. No. 4,598,351 illustrates a typical rampable set point design that includes a reference capacitor coupled in parallel with a zener diode. A constant current source charges the capacitor at start-up to produce a ramping reference voltage fed to the input of an error amplifier. The reference voltage is clamped to a maximum value by the zener diode.

While the rampable set point design works well for its intended applications, the rate at which the capacitor charges to ramp the voltage up is not easily changed. This is because of the discrete component design that minimizes any controllable variation in the rate. Moreover, no provisions are included for changing the set point for the circuit in a predictable, linear manner.

In contrast to the rampable set point construction, modulation limiter designs generally include a grounded capacitor coupled to a forward-biased diode disposed at the input of an error amplifier. The error amplifier is employed in a feedback loop to effect voltage regulation. A second diode is disposed in parallel to the dioded capacitor and selectively couples a normal control signal to the amplifier input node.

In operation, the diode branch with the lowest input voltage to the amplifier sets the control signal. At start-up, the lowest voltage is at the dioded capacitor, which charges up to produce an increasing voltage until the capacitor diode reverse biases, at which time the second diode forward biases, enabling the normal control signal to set the output voltage.

Although modulation limiter circuits perform well for their intended applications, they suffer from many of the problems plaguing conventional rampable designs. Again, because of the arrangements of the discrete components, the slew rate is often non-adjustable. Additionally, typical modulation limiter circuits fail to include circuitry to vary the desired set points.

Therefore, the need exists for a power supply having a slew rate limiting circuit that provides control capability not only for the slew rate, but additionally offers the capability of adjusting the set point in a predictable linear manner. The power supply and method of the present invention satisfies these needs.

SUMMARY OF THE INVENTION

The power supply of the present invention provides a slew rate limiting circuit that offers control capability for the slew rate, and a variability feature for changing the set point of the power supply. These advantages give the present invention a wide flexibility in electronic D.C. power supply applications.

To realize the above advantages, in one form the invention comprises a power supply with a programmable voltage slew rate for generating a regulated voltage at a predetermined set-point. The power supply includes a programmable current source for generating a controllable level of current flow and a capacitive element coupled to the current source. The capacitive element is responsive to the current flow to establish a reference voltage that varies linearly with respect to variations in the current flow. The power supply additionally includes a power device having a control element disposed in sensed communication with the reference voltage and an output for driving a load. The output is operative to generate an output voltage following that of the reference voltage.

In another form, the invention comprises a method of controlling the slew rate of a regulated voltage power supply. The power supply includes a programmable current source, a capacitive element coupled to the power source, and a power device having a control element disposed in sensed communication with the capacitive element and an output. The method includes the steps of: charging the capacitive element to generate a reference voltage; sensing the reference voltage with the control element; and generating an output voltage at the power device output that follows the sensed reference voltage whereby changes in the charging adjust the reference voltage to correspondingly create a proportional change in the output voltage.

Other features and advantages of the present invention will be apparent from the following detailed description when read in conjunction with the accompanying drawings.

DETAILED DESCRIPTION OF THE INVENTION

Figure 1:
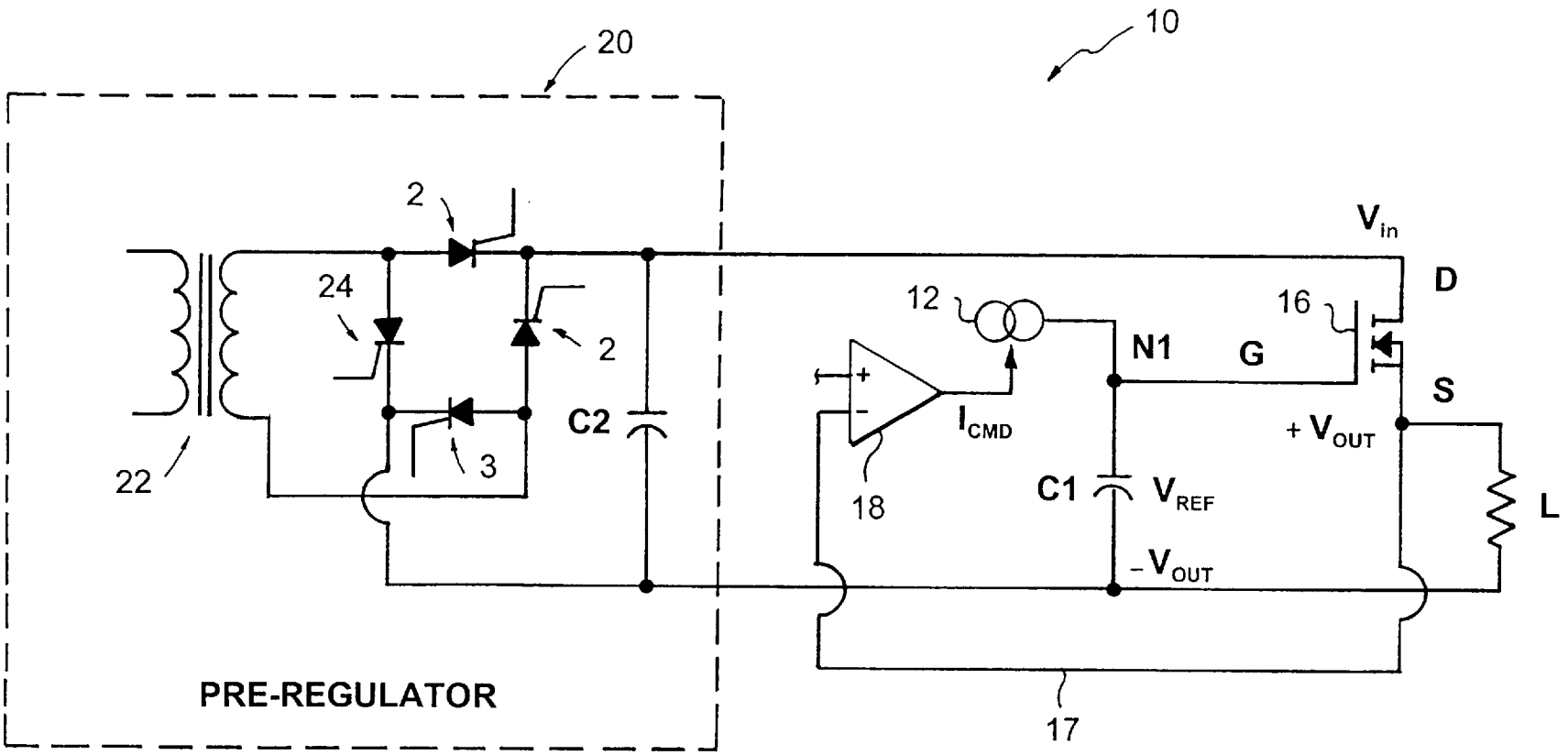
FIG. 1 is a block diagram schematic of a power supply according to one embodiment of the present invention.

Referring now to FIG. 1, the power supply of the present invention according to a first embodiment, generally designated 10, includes a programmable current source 12 for charging a capacitive element C1 to develop a reference voltage Vref. A power device 16 disposed in sensed communication with the reference voltage produces an output that follows the reference voltage. By programmably varying the current through the capacitive element, the power supply output can be predictably adjusted in a linear fashion to drive a load L.

Further referring to FIG. 1, the programmable current source 12 comprises an operational amplifier (not shown) connected in the well-known "bi-polar current source for grounded load" configuration. An error amplifier 18 acts as a controller and produces a current source command signal Icmd and continuously compares the output voltage Vout with a predetermined setpoint signal SP.

The capacitive element C1 comprises a reference capacitor and is tied to a reference node N1 which in turn is connected to the output of the programmable current source 12. Preferably, the current source generates current within the range of approximately +/−0.1 to 1.0 milliamps while the reference capacitor has a capacitance of approximately 0.1 to 1.0 microfarads. These component values produce slew rates of approximately 100 V/s to 10,000 V/s (0.1V/ms to 10V/ms). The opposite end of the capacitor is left floating to define the negative output voltage terminal −Vout for the power supply 10. The negative terminal may then be tied to a negative power supply bus (not shown) for accessibility by one or more loads.

The power device 16 comprises a MOSFET transistor with its gate G connected to the reference node N1. The transistor is employed in a source-follower configuration with the source S providing a voltage output+Vout that closely follows the voltage generated at the node N1 by the capacitor. The output voltage+Vout is sampled by the error amplifier 18 via a feedback connection 17. The source lead may be tied to a positive power supply bus (not shown) in much the same manner as the negative output voltage lead. The drain D of the transistor is tied to a pre-regulated voltage source or pre-regulator 20 which supplies a regulated voltage Vin to power the MOSFET.

The pre-regulator 20 includes an input transformer 22 that receives AC voltage from an AC voltage source (not shown) and a plurality of silicon-controlled-relays (SCR's) 24, 25, 26, and 27 disposed in a well-known bridge configuration. The bridge filters the negative components of the AC waveform and feeds the converted output to a charging capacitor C2, which maintains the SCR bridge output at approximately the maximum AC voltage level to establish a regulated DC level for Vin.

Prior to operation, the desired slew rate of the power supply is preprogrammed into the error amplifier 18 to controllably activate the current source when the power supply is turned on. The programming also includes identifying a threshold set point for the power supply output voltage. The set point comprises the target level that the power supply regulates at.

During normal operation at start-up, the error amplifier 18 issues a maximum-positive control signal to the current source 12 due to the large error between the output voltage and the setpoint. In response, the current source drives current toward node N1. Because of the very high input impedance, virtually none of the current flows into the MOSFET gate G. Consequently, virtually all of the current flows through the reference capacitor C1. The injected current charges the capacitor at a linearly increasing voltage according to the well known equation:

$$V=1/C\int idt$$

The negative side of the capacitor provides the negative output potential −Vout for the power supply.

The power device 16, operating in a source-follower configuration, produces a positive output voltage at its source. The output voltage is the difference between the reference voltage Vref and the nominal gate-source voltage Vgs. When the output voltage is different than the setpoint, the error amplifier 18 generates the command signal Icmd at a level proportional to the determined difference. At ramp-up, however, the error is very large. The error amplifier saturates at the +/−12V floating supply rails (not shown), and the commanded current is a constant. The current remains constant until the output voltage is fairly close to the setpoint, at which time the error amplifier output comes out of saturation and the commanded current is reduced.

I have discovered that by incorporating the current source 12 into a "floating" power supply configuration 10, a wide range of output voltage is available with relatively inexpensive circuit components. For example, to realize a +/−15 volt power supply, the capacitor typically can charge only to about a reference voltage of +/−13 volts. If the +/−15 volt power supply is left floating, as I have discovered, and referenced to the MOSFET source S, then the capacitor voltage can range up to the value of the pre-regulator 20 voltage.

This discovery is especially advantageous in the aerospace industry wherein D.C. power supplies are often utilized to simulate solar cell batteries and the like. Many simulations involve output voltage s on the order of about 200 volts. I have found that at these high voltages, the output voltage regulation is very good. This is because the MOSFET gate to source voltage only increases from about 3 volts to 5 volts when the output current goes from no-load to full-load. Additionally, because the reference voltage developed by the capacitor C1 is essentially isolated from any loads, system response may be tailored independent of the load.

Figure 2:
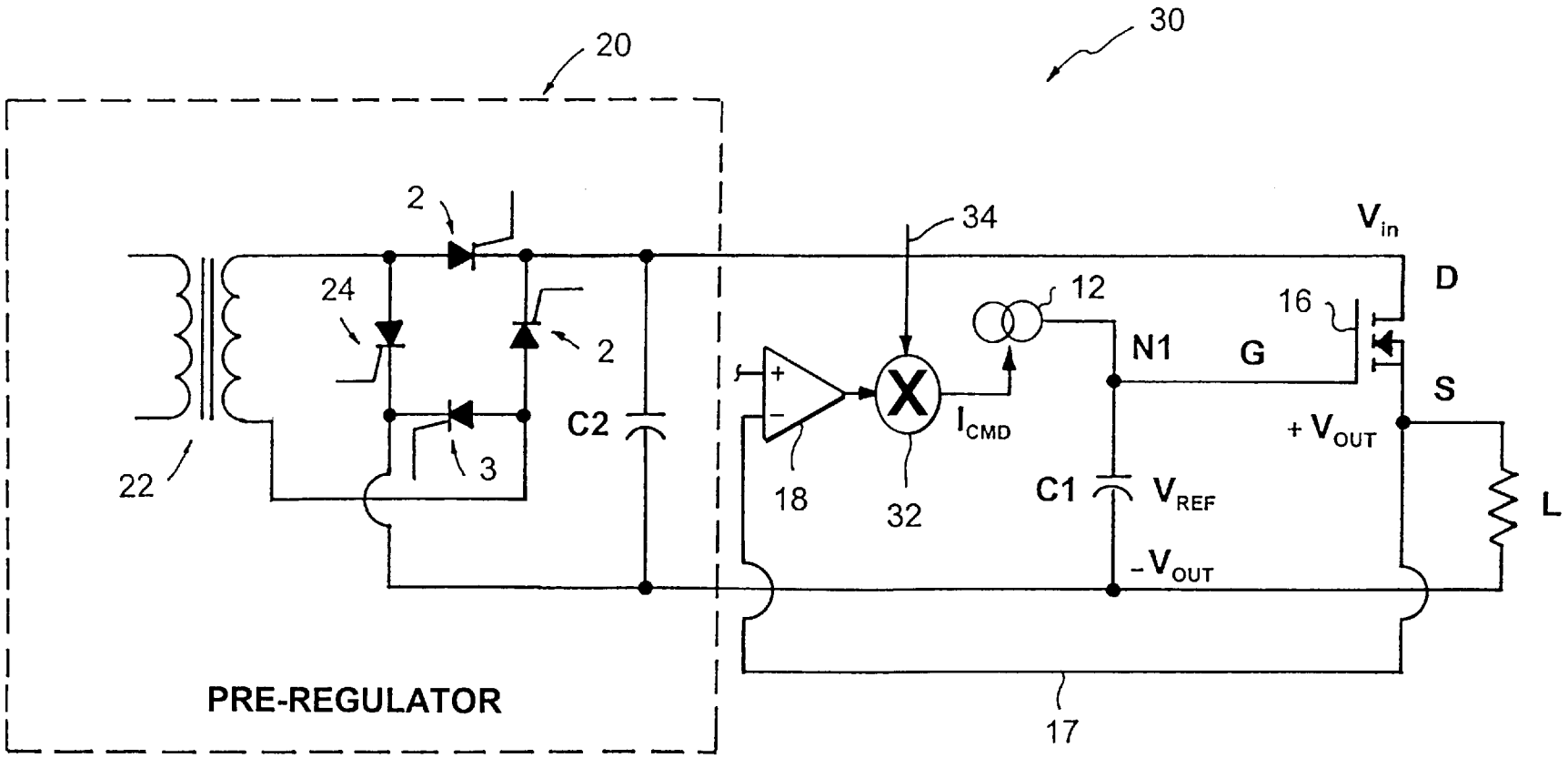
FIG. 2 is a block diagram schematic of the present invention according to a second embodiment.

Referring now to FIG. 2, the present invention according to a second embodiment, generally designated 30, includes much of the circuitry described in the foregoing first embodiment, with like numerals indicating like components. The power supply includes a pre-regulator circuit 20, an error amplifier 18, a programmable current source 12, a reference capacitor C1, and a power device 16. In contrast to the power supply 10 described as the first embodiment, the second embodiment adds a multiplying digital-to-analog (DAC) converter 32 between the output of the error amplifier and the input to the current source. The multiplying DAC reduces the error signal to a preselected multiplicative constant. A separate digital controller 34 is connected to the DAC and loads a programmed scale factor into the DAC. The separate digital controller preferably comprises an 8-bit microcontroller with 1 k–2 k bytes of memory to load the scaling factor. Prior to operation, the desired slew rate of the power supply is preprogrammed into the error amplifier 18 to controllably activate the current source 12 when the power supply 30 is turned on. The programming for this embodiment of the present invention is conveniently carried out by the separate digital controller 34 that latches a digital value in to the multiplying digital-to-analog converter (DAC) 32 (FIG. 2). The output of the DAC 32 comprises the product of the analog input (error amplifier 18 output) and the digital scaling factor. In this way, the digital controller 34 can accurately set the maximum current out of the current source 12. This capability also changes the response of the power supply 30 to transient loads since all error amplifier signals are multiplied by the scale factor.

Figure 3:
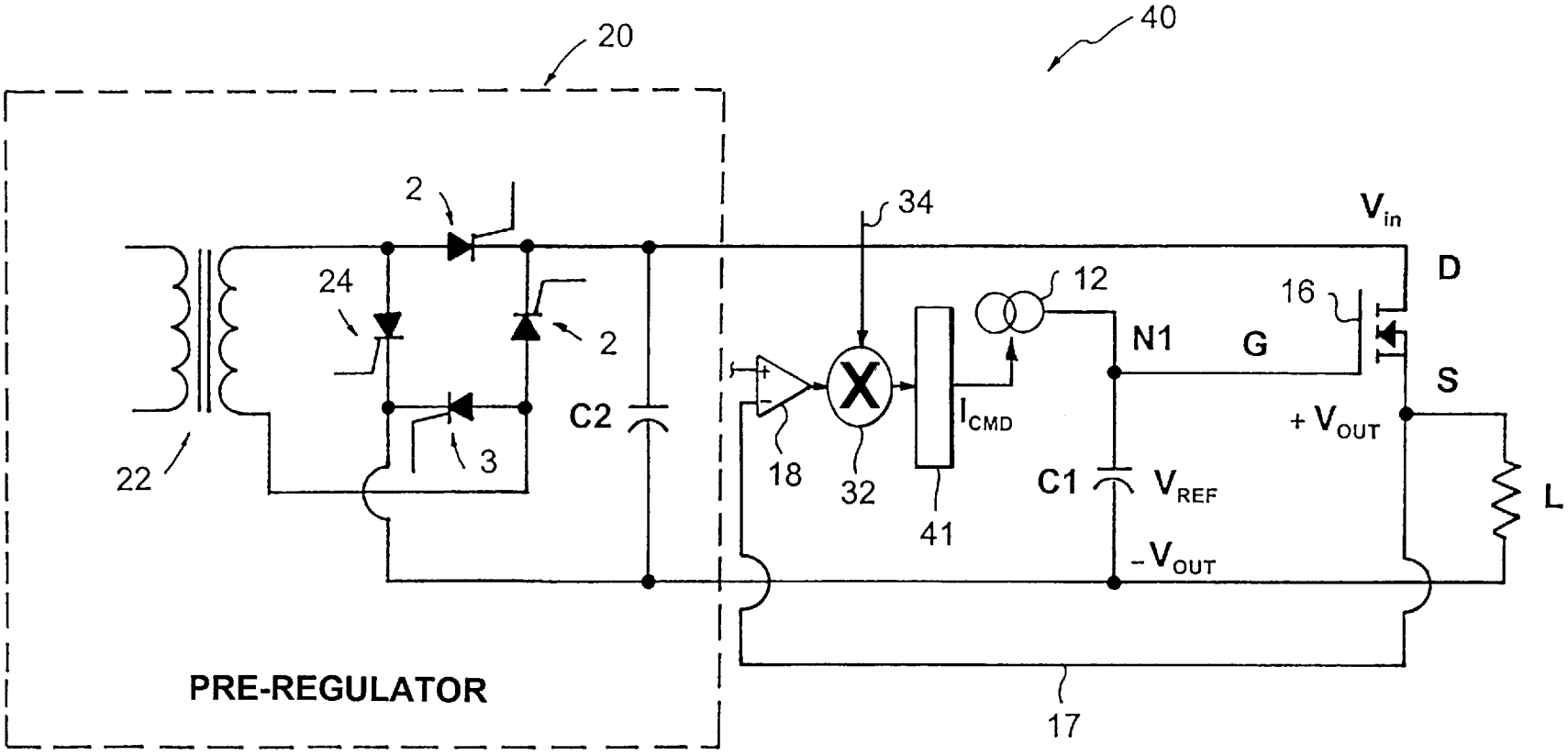
FIG. 3 is a block diagram schematic of the present invention according to a third embodiment.
Figure 4:
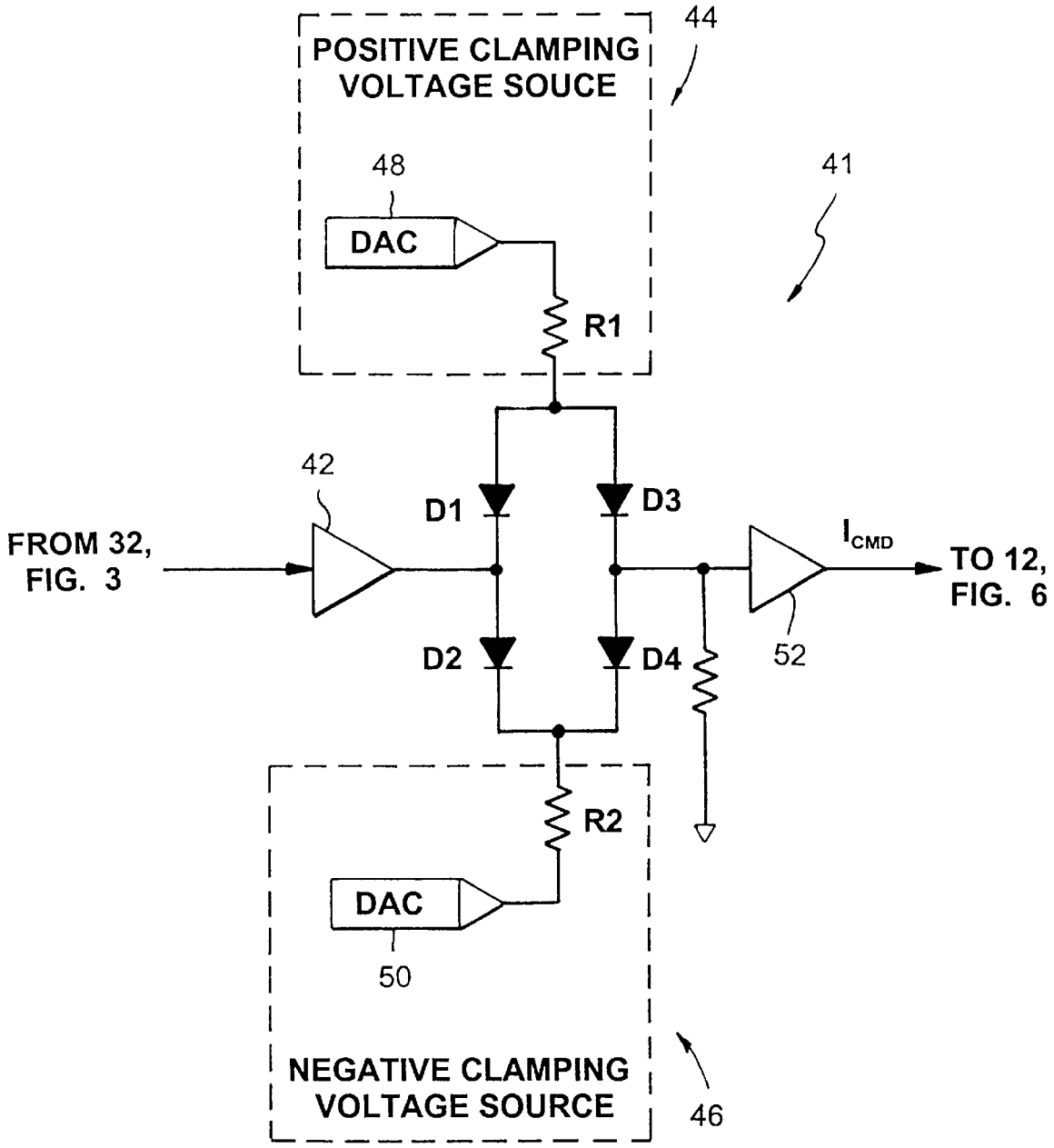
FIG. 4 is a block diagram schematic of a clamping circuit employed in the power supply of FIG. 3.

Referring now to FIGS. 3 and 4, the present invention according to a third embodiment, generally designated 40, employs the components described in the second embodiment, with like numerals indicating like components, and adds a well-known programmable voltage clamping circuit 41 disposed between the multiplying DAC 32 output and the current source 12 input. The clamping circuit cooperates with the multiplying DAC to further reduce the error signal to the preselected maximum value.

Referring more particularly to FIG. 4, the clamping circuit 41 includes an input buffer amplifier 42 that feeds the signal output from the multiplying DAC 32 to a diode bridge comprising diodes D1, D2, D3 and D4. The bridge is balanced by respective positive and negative clamping voltage sources 44 and 46 that include respective DACs 48 and 50 and resistors R1 and R2. The bridge output feeds an output buffer amplifier 52 that produces a clamped signal output. Alternatively, the clamping circuit is realized by an integrated circuit, such as that marketed under the trademark Clamp-Amp®

In operation, the clamping circuit 41 acts to set the maximum current to the input of the current source 12. The clamping levels for the clamping circuit are set by latching digital values from the digital controller 34 and into clamping-level DACs. If the input signal exceeds the positive clamping voltage, diodes D1 and D4 will be off, while diode D2 conducts current. Diode D3 then sets the output voltage to the clamping voltage (less one diode voltage drop of approximately 0.7 volts). If the signal is within a normal range, the voltage drops on diodes D1 and D3 will cancel and the output voltage will equal the input voltage.

Those skilled in the art will appreciate the many benefits and advantages offered by the present invention. Of significant importance is the feature of providing a programmable current source to linearly adjust the slew rate of the power supply. Moreover, the invention offers the capability of adjusting the set point of the power supply in a linear manner using relatively inexpensive discrete components.

While the invention has been particularly shown and described with reference to the preferred embodiments thereof, it will be understood by those skilled in the art that various changes in form and detail may be made therein without departing from the spirit and scope of the invention.

What is claimed is:

1. A power supply with a programmable voltage slew rate for generating a regulated voltage at a predetermined set-point, said power supply including:

a programmable current source for generating a controllable level of current flow;

a capacitive element coupled to said current source and responsive to said current flow to establish a reference voltage, said reference voltage varying linearly with respect to variations in said current flow; and a power device having a control element electrically connected to said reference voltage and an output for driving a load, said output operative to generate an output voltage following that of said reference voltage.

2. A power supply according to claim 1 wherein said programmable current source comprises:

an operational amplifier disposed in a bi-polar current source for grounded load configuration.

3. A power supply according to claim 1 and further including:

a feedback circuit for detecting said output voltage and controlling said current source based on said output voltage level.

4. A power supply according to claim 3 wherein said feedback circuit includes:

an error amplifier having a first input connected to said voltage output and a second input coupled to a predetermined setpoint voltage, said error amplifier operative to determine the difference between said voltage output and said setpoint voltage and generate a command current signal to linearly control said current source.

5. A power supply according to claim 4 and further including:

a multiplying digital-to-analog converter disposed between said error amplifier and said current source; and a digital controller coupled to said digital-to-analog converter and including memory for storing a scaling factor, said controller operative to load said scaling factor into said multiplying digital-to-analog converter and establish a maximum level of current into said current source.

6. A power supply according to claim 5 and further including:

a clamping circuit interposed between said multiplying digital-to-analog converter and said current source.

7. A power supply according to claim 1 wherein:

said capacitive element comprises a capacitor having respective positive and negative voltage terminals.

8. A power supply according to claim 7 wherein:

said output is referenced to said capacitor negative terminal.

9. A power supply according to claim 1 and further including:

a pre-regulated voltage source; and said power device including an input coupled to said voltage source.

10. A power supply according to claim 1 wherein:

said power device comprises a MOSFET.

11. A power supply with a programmable voltage slew rate for generating a regulated voltage at a predetermined set-point, said power supply including:

current generating means for generating a controllable level of current flow;

reference means coupled to said current source and comprising a capacitive element, the reference means responsive to said current flow to establish a reference voltage, said reference voltage varying linearly with respect to variations in said current flow; and power means coupled to said reference means and having an output operative to generate an output voltage following that of said reference voltage.

12. A power supply according to claim 11 wherein:

said current generating means comprises a programmable current source.

13. A power supply according to claim 11 wherein:

said capacitive element comprises a capacitor.

14. A power supply according to claim 11 wherein:

said power means comprises a power device having a control element electrically connected to said reference voltage and an output for driving said load.

15. A power supply according to claim 14 wherein:

said power means output is referenced to said capacitive element.

16. A power supply according to claim 14 wherein:

said power device comprises a MOSFET.

17. A power supply with a programmable voltage slew rate for generating a regulated voltage at a predetermined set-point, said power supply including:

a programmable current source for generating a controllable level of current flow;

a capacitive element coupled to said current source and responsive to said current flow to establish a reference voltage, said reference voltage varying linearly with respect to variations in said current flow; and a power device having a control element electrically connected to said reference voltage and an output for driving a load, said output operative to generate an output voltage following that of said reference voltage;

a feedback circuit including an error amplifier for detecting said output voltage and controlling said current source based on said output voltage level;

a multiplying digital-to-analog converter disposed between said error amplifier and said current source;

a digital controller coupled to said digital-to-analog converter and including memory for storing a scaling factor, said controller operative to load said scaling factor into said multiplying digital-to-analog converter and establish a maximum level of current into said current source; and a clamping circuit interposed between said multiplying digital-to-analog converter and said current source.

18. A power supply with a programmable voltage slew rate for generating a regulated voltage at a predetermined set-point, said power supply including:

a programmable current source for generating a controllable level of current flow;

a capacitive element coupled to said current source and responsive to said current flow to establish a reference voltage, said reference voltage varying linearly with respect to variations in said current flow; and a power device having a control element electrically connected to said reference voltage and an output for driving a load, said output operative to generate an output voltage following that of said reference voltage;

a feedback circuit including an error amplifier for detecting said output voltage and controlling said current source based on said output voltage level;

a multiplying digital-to-analog converter disposed between said error amplifier and said current source; and a digital controller coupled to said digital-to-analog converter and including memory for storing a scaling factor, said controller operative to load said scaling factor into said multiplying digital-to-analog converter and establish a maximum level of current into said current source.

19. A power supply according to claim 18 and further including:

a clamping circuit interposed between said multiplying digital-to-analog converter and said current source.

20. A method of linearly varying the set point of a regulated voltage power supply, said power supply including a programmable current source, a capacitive element coupled to said current source, and a power device having a control element electrically connected to said capacitive element and an output, said method including the steps of:

operating said power supply in a floating configuration wherein the programmable current source is controlled with reference to an output voltage and without reference to an external ground; and varying current from said current source to vary said reference voltage.

21. A method of controlling the slew rate of a regulated voltage power supply, said power supply including a programmable current source, a capacitive element coupled to said current source, and a power device having a control element electrically connected to said capacitive element and an output, said method including the steps of:

charging said capacitive element to generate a reference voltage;

sensing said reference voltage with said control element; and generating an output voltage at said power device output that follows said reference voltage, said charging step effective to adjust said reference voltage to correspondingly create a proportional change in said output voltage.

22. A method according to claim 21 wherein:

said step of charging includes driving said capacitive element with current from said current source.

23. A method according to claim 22 wherein:

said step of driving includes programmably injecting current into said capacitive element according to predetermined instructions.

24. A method according to claim 23 wherein:

said injecting step includes varying said reference voltage linearly with changes in said current flow.

25. A method according to claim 21 and further including the step of:

referencing said reference voltage to said power device output.

* * * * *